US007277658B2

(12) United States Patent
Carter, II et al.

(10) Patent No.: US 7,277,658 B2
(45) Date of Patent: Oct. 2, 2007

(54) SEALING MEMBER FOR IMAGE FORMING DEVICE

(75) Inventors: James Anthany Carter, II, Lexington, KY (US); Benjamin Keith Newman, Lexington, KY (US); Matthew Lee Rogers, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 168 days.

(21) Appl. No.: 11/190,715

(22) Filed: Jul. 27, 2005

(65) Prior Publication Data

US 2007/0025756 A1 Feb. 1, 2007

(51) Int. Cl.
*G03G 15/08* (2006.01)

(52) U.S. Cl. ..... 399/103; 399/102; 399/105; 399/106

(58) Field of Classification Search ..... 399/102, 399/103, 105, 106, 107; 277/549, 551, 572, 277/573, 574
See application file for complete search history.

(56) References Cited

U.S. PATENT DOCUMENTS

| | | | | |
|---|---|---|---|---|
| 5,758,233 | A | 5/1998 | Coffey et al. | |
| 5,802,432 | A | 9/1998 | Coffey et al. | |
| 6,157,797 | A * | 12/2000 | Saito et al. | 399/107 |
| 6,871,031 | B2 | 3/2005 | Blaine et al. | |
| 2001/0001025 | A1 * | 5/2001 | Nakajima | 399/262 |
| 2002/0150402 | A1 * | 10/2002 | Buchanan et al. | 399/103 |

* cited by examiner

*Primary Examiner*—David M Gray
*Assistant Examiner*—Ryan D. Walsh
(74) *Attorney, Agent, or Firm*—Grossman, Tucker, Perreault & Pfleger, PLLC

(57) ABSTRACT

A sealing member for an image forming device as well as an apparatus and method of locating components within a printing device. The image forming device may include laser printers, ink-jet printers, copiers, faxes, all-in-one devices or multifunctional devices.

22 Claims, 4 Drawing Sheets

SEALING MEMBER FOR IMAGE FORMING DEVICE

FIELD OF THE INVENTION

This invention relates to sealing members for use in image forming device. The invention also relates to an apparatus and method of positioning a plate relative to a housing in an imaging forming device. The image forming device may include an electrophotographic device, ink printer, copier, fax, all-in-one device or multi-functional device.

BACKGROUND OF THE INVENTION

An image forming device, such as an electrophotographic device, ink printer, copier, fax, all-in-one device or multi-functional device may use developing agent such as toner or ink, which may be disposed on media to form an image. The developing agent, such as toner, may be fixed to the media using an image fixing apparatus, which may apply heat and/or pressure to the toner. The image fixing apparatus may also include a nip through which the media may be passed. The nip may be formed by a heater opposing a pressure roller. A belt or film may be included in the fixing device, in proximity to the heater to aid the transport of media through the fixing device nip.

SUMMARY OF THE INVENTION

In one exemplary embodiment the present invention is directed at a sealing member positioned between components in an image forming device. For example, sealing between moving and stationary components in a printer, such as a moving roller relative to a plate and housing in an image forming device. The sealing member may also be used in a toner cartridge. The sealing member may therefore comprise a first seal portion for sealing a roller and a second seal portion for sealing a space between a plate and a housing. In another exemplary embodiment the present invention is directed at an apparatus and method of positioning a plate relative to a housing. For example, positioning a gear plate to a housing in an image forming device.

BRIEF DESCRIPTION OF THE DRAWINGS

A brief description of the exemplary drawings is as follows.

DETAILED DESCRIPTION

Figure 1:
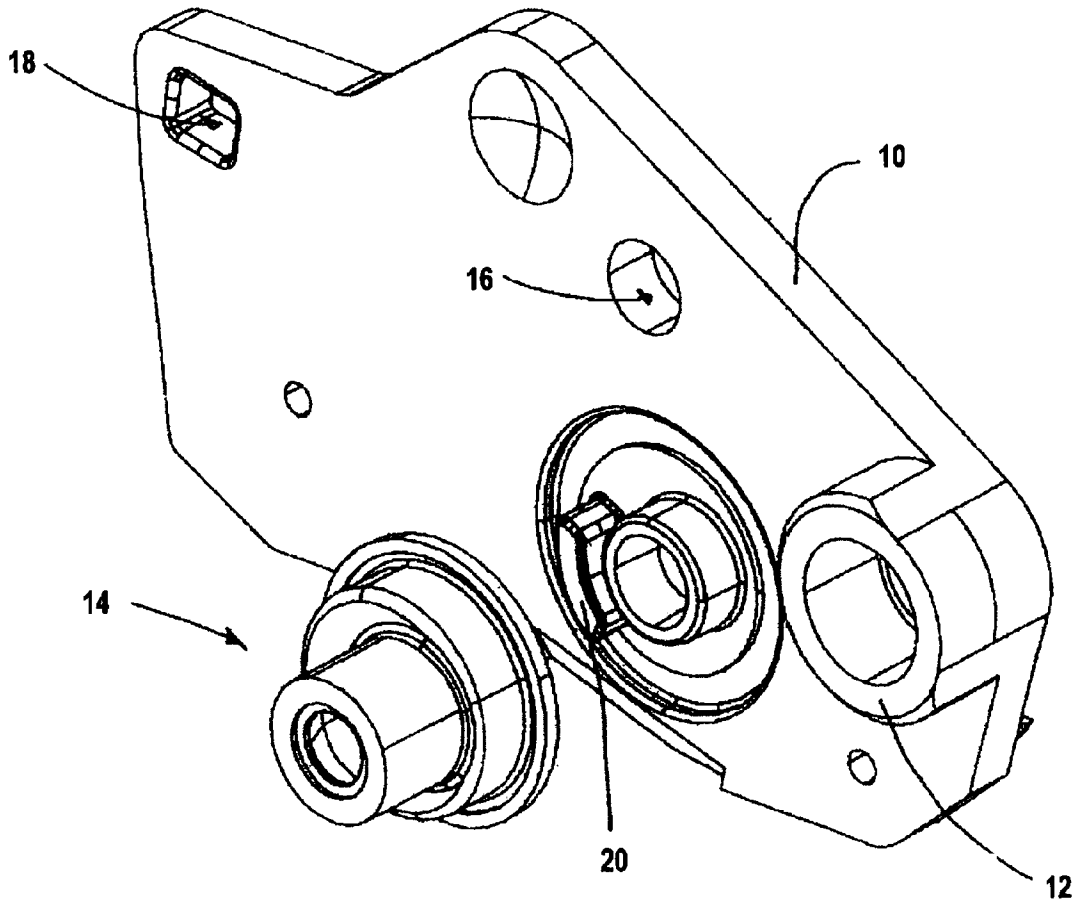
FIG. 1 is a perspective view of an exemplary sealing member according to the present invention.

FIG. 1 is a perspective view of an exemplary plate 10 which includes an exemplary boss 12 that may engage, e.g., with a partial hole with an open side on an exemplary housing. The plate 10 may be a gear plate which supports other gears associated with printing. Although the plate 10 is therefore illustrated in FIG. 1 as a relatively flat configuration, it should be appreciated that the plate herein may include any sort of structure that may incorporate, e.g., a boss or other features for engaging with other components within the image forming device. The image forming device may include an electrophotographic device, ink printer, copier, fax, all-in-one device or multi-functional device.

Figure 4:
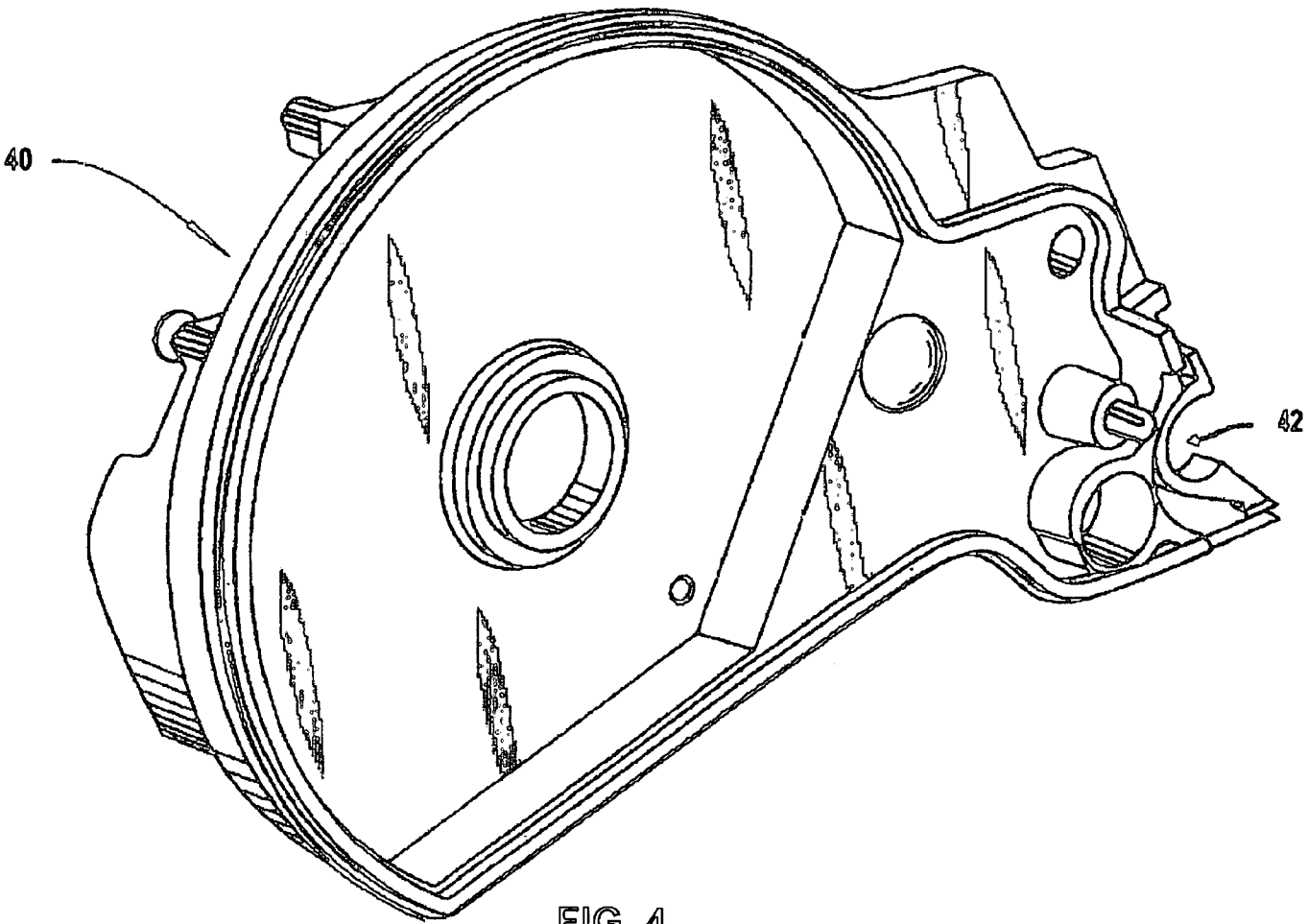
FIG. 4 is a perspective view of the exemplary housing.

The plate 10 may receive and locate an exemplary multifunctional seal 14. The plate 10 may further include a hole 16 for receiving a screw (not shown) for attachment to the exemplary housing 40 (see FIG. 4). A locating hole 18 (e.g. a rectangular opening) may be provided to interface with a protrusion (e.g. a round pin not shown) on housing 40 which may control rotational position of the plate 10 relative to the housing 40. However, within the context of the present invention, the geometry of the protrusion and opening may vary. X and Y plane location of the plate 10 may be controlled by the engagement of boss 12 in the C-shaped opening 42 (see FIG. 4) in housing 40. X and Y plane location may of course be developed by engagement of other types of protrusions other than a boss in other types of openings other than a C-shaped opening. The X and Y plane location are illustrated in FIG. 1 with respect to the illustrated and non-limiting example of the present invention.

An anti-rotation feature 20 may be located adjacent boss 12 for receiving seal 14. A boss 21 is also illustrated. Seal 14 thus may slide onto a shaft 30 (see FIG. 3) such as a toner adder roller shaft. The seal 14 may therefore effectively seal to the shaft and may also provide a gasketing surface between the plate 10 and housing 40.

Figure 2:
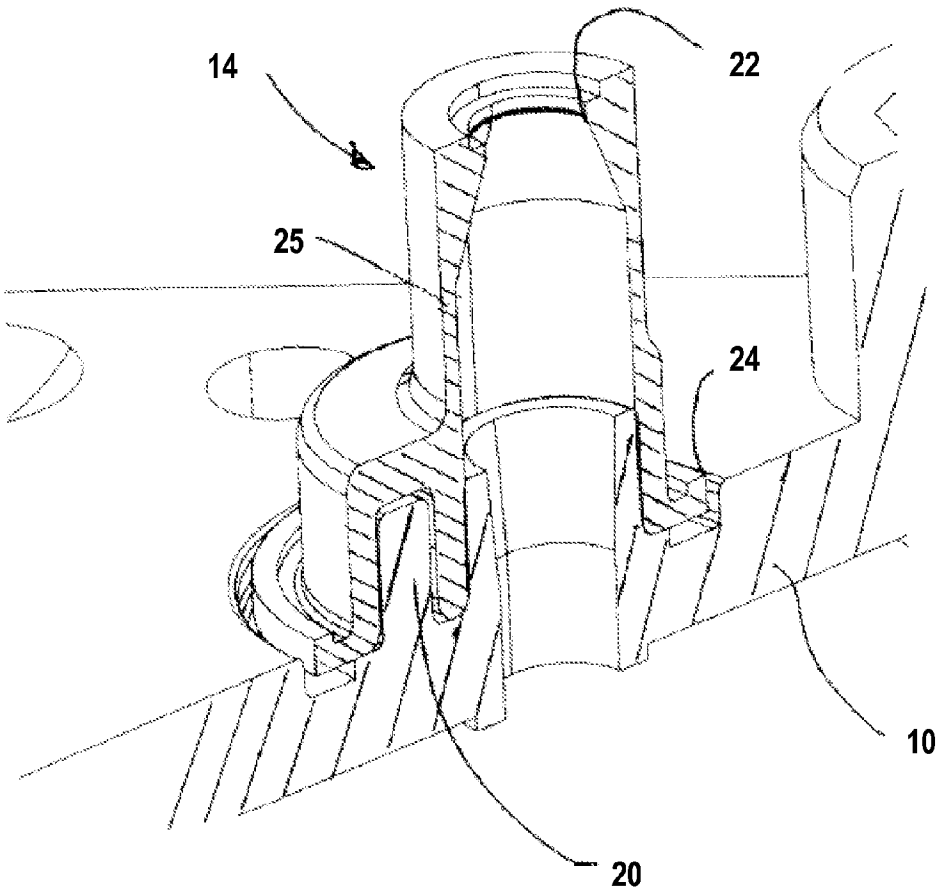
FIG. 2 is a sectional view of the exemplary sealing member and gear plate of FIG. 1.

An exemplary engagement of seal 14 to plate 10 is shown in sectional view in FIG. 2. This view provides additional detail of the lip seal portion 22 which may engage the roller shaft while the cantilevered gasket seal 24 portion may engage the plate 10. The seal may include a relatively thicker lip seal portion 22 and relatively thinner wall section 25 in the lower tubular body which may allow for some misalignment between the seal 14 and roller shaft. The flexible seal 14 may also add to the ability of the C-shaped hole 42 (FIG. 4) to locate the gear plate 10. Also illustrated in FIG. 2 in sectional view is the anti-rotation boss 20 for the seal 14.

Figure 3:
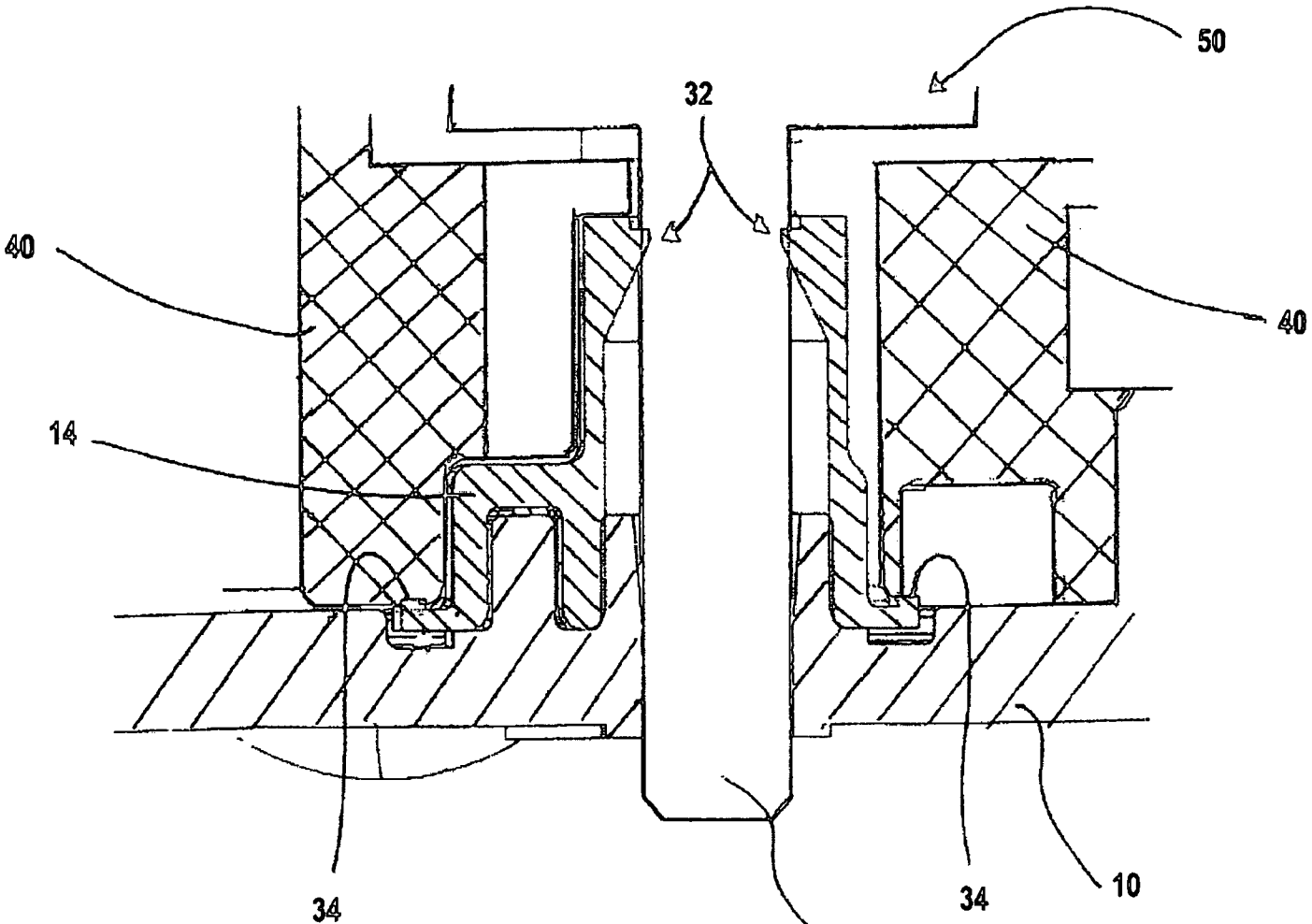
FIG. 3 is a sectional view of the exemplary seal and gear plate of FIG. 1 engaged with an exemplary housing.

FIG. 3 is a cross sectional view of the exemplary gear plate 10 and seal 14 installed to housing 40 and engaging shaft 30 of roller 50. As can be seen, the seal 14 may include a cantilevered gasket portion indicated at 34. FIG. 3 therefore illustrates engagement of the lip seal portion 32 with the shaft 30 and cantilevered gasket portions 34 with housing 40. The opposite end of the roller shaft 30 may engage a sintered bronze or conductive plastic bearing and then also seal to the housing. Such seal may be a lip seal.

The gear plate 10 may comprise a material which may act as a bearing surface for the toner adder shaft 30. The material may include, but is not limited to, sintered metal (bronze, stainless steel) and carbon or graphite filled plastics (such as polyethylene terephthalate, polyetherether ketone, polyimide and fluorocarbons). The material may also comprise a glass filled nylon, e.g., a 30% glass filled nylon-6,6 with 15% of a fluropolymer additives, e.g., polytetrafluoroethylene (PTFE). Accordingly, all of these materials may contain additives which may improve wear resistance, lubricity, hardness and load deflection.

The multifunctional seal of the present invention may comprise a flexible, relative low modulus rubber or plastic material including (e.g. flex modulus less than about 150,000 psi including all values and ranges between 1.0-150,000 psi). This may include any thermoplastic or thermoset elastomer. It may include polyurethanes, thermoplastic olefins, diene based elastomers, styrene-butadiene elastomers, and/or polyester based elastomers. It may also include natural rubber and thermoplastic elastomers which may have been vulcanized (cross-linked). More preferably, the seal may comprise a Santoprene™ from Advanced Elastomer Systems.

For purposes of example only, various embodiments of the invention have been shown and described above. However, it will be apparent that changes and modifications in the arrangement and construction of the parts thereof may be resorted to without departing from the spirit and scope of the invention.

What is claimed is:

1. A sealing member positioned between a moving component, plate and housing in an image forming device comprising a first seal portion positioned between said component and said plate and a second seal portion positioned between said plate and said housing; wherein said sealing member includes a cantilevered circular ring gasket.

2. The sealing member of claim 1 wherein said moving component is a roller shaft.

3. The sealing member of claim 1 wherein said sealing member comprises a tubular body having a length, said tubular body having a wall thickness, wherein said wall thickness varies along said length.

4. The sealing member of claim 1 wherein said second seal portion is biased against said housing.

5. The sealing member of claim 1 including an anti-rotation feature on said sealing member to reduce rotation of said sealing member with respect to said moving component.

6. The sealing member of claim 1, wherein the sealing member is made from a material having a Shore A hardness of from about 55 to about 75.

7. The sealing member of claim 1 wherein said sealing member is made from a material with a flexural modulus of less than about 150,000 psi.

8. The sealing member of claim 1, wherein said member comprises thermoplastic elastomer.

9. A toner cartridge for an image forming apparatus, said cartridge comprising a housing and a roller including a shaft, a plate, and including a sealing member, wherein said sealing member includes a first seal portion positioned between said roller shaft and said plate and a second seal portion positioned between said plate and said housing and wherein said sealing member includes a cantilevered circular ring gasket.

10. The cartridge of claim 9 wherein said sealing member comprises a tubular body having a length, said tubular body having a wall thickness, wherein said wall thickness varies along said length.

11. The cartridge of claim 9 wherein said second seal portion is biased against said housing.

12. The cartridge of claim 9 including an anti-rotation feature on said sealing member to reduce said sealing member from rotating with respect to said shaft.

13. The cartridge of claim 9, wherein the sealing member is made from a material having a Shore A hardness of from about 55 to about 75.

14. The cartridge of claim 9 wherein said sealing member is made from a material with a flexural modulus of less than about 150,000 psi.

15. The cartridge of claim 9 wherein said sealing member comprises thermoplastic elastomer.

16. The cartridge of claim 9 wherein said roller comprises a toner adder roller.

17. The cartridge of claim 9 wherein said plate comprises a gear plate.

18. An assembly for positioning components in an imaging forming device comprising:

a housing having a side portion including a location to engage a boss;

a projection extending outward from said side portion;

a plate including an opening for engaging said projection, said plate further in boss, wherein said boss engages said location in said housing; and a sealing member wherein said sealing member includes a first seal portion for sealing a moving component and a second seal portion positioned between said plate and said housing.

19. The assembly of claim 18 wherein said projection is circular and said opening for engaging said projection is rectangular.

20. The assembly of claim 18 wherein said sealing member is made from a material with a flexural modulus of less than about 150,000 psi.

21. A method of positioning components in an image forming device housing wherein said housing has a side portion including a boss-engaging location and a projection extending from said side portion, and a plate having an opening for engaging said projection and including a boss, wherein said plate further includes a sealing member to position between said plate and a moving component in said image forming device comprising:

positioning said boss of said plate in said location on said housing;

positioning said projection of said housing in said opening in said plate; and positioning said sealing member between said plate and said moving component.

22. The method of claim 21 comprising positioning said sealing member between said plate and said housing.

* * * * *